US012709456B2

(12) United States Patent
Kaiser et al.

(10) Patent No.: US 12,709,456 B2
(45) Date of Patent: Aug. 18, 2026

(54) NON-ASPIRATING TRANSPORT GEL DISPENSER

(71) Applicant: AMERICAN STERILIZER COMPANY, Mentor, OH (US)

(72) Inventors: Nancy-Hope E. Kaiser, Pontoon Beach, IL (US); Daniel Rochette, Quebec (CA); Bradley A. Baan, Eureka, MO (US)

(73) Assignee: American Sterilizer Company, Mentor, OH (US)

( * ) Notice: Subject to any disclaimer, the term of this patent is extended or adjusted under 35 U.S.C. 154(b) by 0 days.

(21) Appl. No.: 18/431,183

(22) Filed: Feb. 2, 2024

(65) Prior Publication Data

US 2024/0174432 A1 May 30, 2024

Related U.S. Application Data

(63) Continuation of application No. 17/752,948, filed on May 25, 2022, now Pat. No. 11,926,467, which is a continuation of application No. 16/664,261, filed on Oct. 25, 2019, now abandoned, which is a continuation of application No. 14/929,697, filed on Nov. 2, 2015, now abandoned.

(51) Int. Cl.

| | |
|---|---|
| ***B65D 35/28*** | (2006.01) |
| ***B65D 83/141*** | (2025.01) |
| ***B65D 83/62*** | (2006.01) |

(52) U.S. Cl.

CPC ..... *B65D 83/62* (2013.01); *B65D 83/141* (2025.01)

(58) Field of Classification Search

CPC .... B65D 83/62; B65D 83/752; B65D 83/435; B65D 83/206; B65D 83/303; B65D 83/38; B65D 83/48; B65D 83/68; B65D 35/28; B65D 35/10; B65D 35/18

USPC ..... 222/103, 95, 105, 107, 402.1, 135, 136

See application file for complete search history.

(56) References Cited

U.S. PATENT DOCUMENTS

| | | | | |
|---|---|---|---|---|
| 5,630,530 | A | 5/1997 | Geier et al. | |
| 5,915,595 | A | 6/1999 | Dow et al. | |
| 5,976,573 | A * | 11/1999 | Kim | A61K 9/0043 424/490 |
| 6,085,945 | A | 7/2000 | Fransen | |
| 6,387,858 | B1 | 5/2002 | Shah et al. | |

(Continued)

*Primary Examiner* — Charles P. Cheyney

(74) *Attorney, Agent, or Firm* — Hudak, Shunk & Farine Co. LPA

(57) ABSTRACT

A non-aspirating dispenser containing a gel therein for delivery to a desired surface such as a medical article. More specifically, a gel that is dispensed in the form of droplets that are free of air or a gas therein and with reduced drift potential. The dispenser has a container having a flexible bag therein enclosing a thixotropic gel, and has a pressurized gas that is capable of exerting pressure on the bag and forcing the gel out of said bag in a steady stream upon pressing an actuator that is operatively connected to an ejection valve. The bag is free of propellants, and does not produce an aerosol. The gel is thixotropic and is utilized for keeping medical instruments moist in order to prevent soils present thereon from drying out, which can make reprocessing of medical instruments more difficult and less effective. The dispenser implemented at a point of use for transport or prior to delayed reprocessing in the reprocessing area.

11 Claims, 1 Drawing Sheet

(56) References Cited

U.S. PATENT DOCUMENTS

| | | | | |
|---|---|---|---|---|
| 6,547,770 | B2 * | 4/2003 | Carlsson | B65D 83/752 604/141 |
| 6,622,943 | B2 | 9/2003 | Poisson et al. | |
| 6,682,726 | B2 | 1/2004 | Marchesi et al. | |
| 6,695,227 | B1 * | 2/2004 | Hayashi | B65D 83/75 239/340 |
| 7,909,264 | B2 | 3/2011 | Dunne et al. | |
| 8,668,899 | B2 | 3/2014 | Dowling et al. | |
| 8,752,737 | B2 * | 6/2014 | Ghavami-Nasr | B65D 83/48 222/402.1 |
| 8,857,741 | B2 * | 10/2014 | Morikis | A61K 8/9794 514/642 |
| 8,876,020 | B2 | 11/2014 | Holladay et al. | |
| 8,978,936 | B2 * | 3/2015 | Eini | B65D 83/525 222/402.1 |
| 2009/0324521 | A1 | 12/2009 | Cetti et al. | |
| 2010/0218845 | A1 | 9/2010 | Fishman | |
| 2012/0071581 | A1 | 3/2012 | Sklar | |
| 2012/0298777 | A1 | 11/2012 | Holladay et al. | |
| 2013/0345647 | A1 | 12/2013 | Har-Shai | |
| 2014/0187469 | A1 | 7/2014 | Powell | |
| 2015/0014364 | A1 | 1/2015 | Greenfield et al. | |
| 2015/0056149 | A1 | 2/2015 | Tamarkin et al. | |
| 2018/0272367 | A1 * | 9/2018 | Rayner | B65D 83/62 |

* cited by examiner

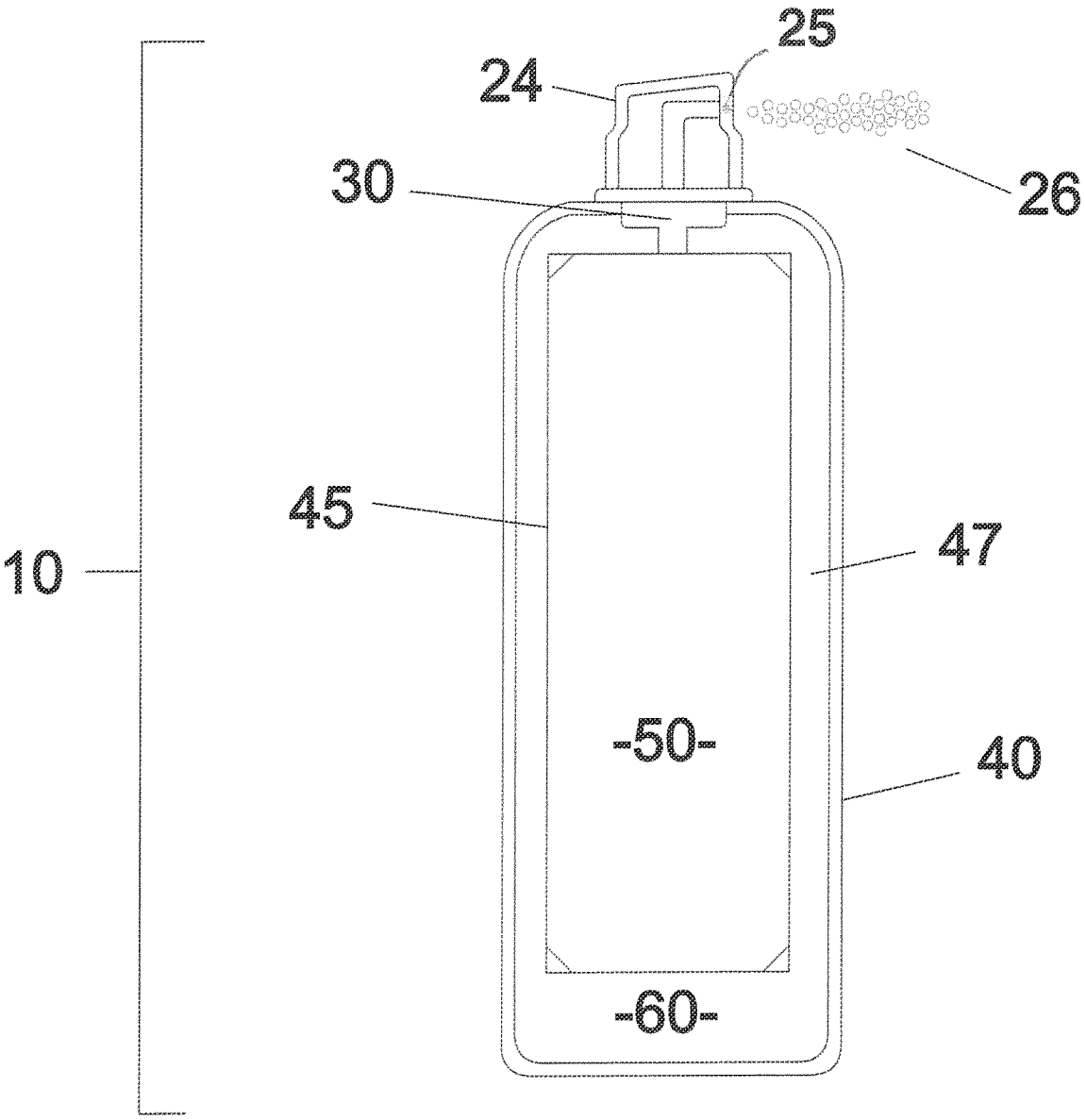
26
25
24
30
45
47
40
-50-
-60-
10

NON-ASPIRATING TRANSPORT GEL DISPENSER

FIELD OF THE INVENTION

The present invention relates to a non-aspirating dispenser containing a gel therein for delivery to a desired surface such as a medical article. More specifically, the invention relates to a gel that is dispensed in the form of droplets that are free of air or a gas therein and with reduced drift potential. The dispenser comprises a container having a flexible bag therein enclosing a thixotropic gel, and comprising pressurized gas that is capable of exerting pressure on said bag and forcing said gel out of said bag in a steady stream upon pressing an actuator that is operatively connected to an ejection valve. The bag is free of propellants, and does not produce an aerosol. The gel is thixotropic and is utilized for keeping medical instruments moist in order to prevent soils present thereon from drying out, which can make reprocessing of medical instruments more difficult and less effective. This invention can be implemented at a point of use for transport or prior to delayed reprocessing in the reprocessing area.

BACKGROUND OF THE INVENTION

Typical spray bottles or containers dispense liquids or foams via a mechanical trigger that requires continual pumping thereof to dispense a sprayed product. Since very small amounts of product are dispensed with each pump, numerous pumps are required to adequately cover a surface. The same often exhausts the user and becomes an ergonomic issue in that in spraying numerous surfaces, articles, etc., can require a person to take a break or rest.

Moreover, various dispensers, such as a spray bottle, eject a fluid via aspiration such that an aerosol mist is formed. These dispensers are undesirable in sterile situations since the air pulled in by the aspirator can be from a contaminated environment. Moreover, the aerosol droplets are small and hence driftable such that they can be carried into an adjacent sterile environment and contaminate the same. Liquid-based instrument transport products are to be avoided as they require filled containers or basins to cover all instrument surfaces and thus increase weight and sloshing of transported items.

Various other dispensers contain a sprayable liquid in association with propellants such as volatile hydrocarbons, e.g. butane, propane, or fluorocarbon gases that can pose flammable or toxic problems.

Examples of specific dispensers include the following:

U.S. Pat. No. 6,085,945, issued Jul. 11, 2000. A distributor for a product under pressure has a receptacle which defines a receiving volume. A valve having a springy press-on valve shaft and a non-return valve part is mounted on the receptacle. A passage through which the valve shaft may communicate with the receiving volume is provided. A valve seating section is arranged such that the passage is closed off when the valve shaft is in a rest position and is open when the valve shaft is pressed on. A flexible bag which defines an interior space is provided within the receptacle with the valve seating section outside the bag, and the bag is connected to the valve shaft by the non-return valve part such that flow of a pressurized medium may flow through the valve shaft toward the interior space, but reverse flow is blocked. Flow of pressurized medium out of or into the receptacle through the valve shaft may be obtained without releasing pressure from the pressurized bag.

U.S. Pat. No. 6,622,943 B2, issued Sep. 23, 2003. Disclosed is a method of shaving hair by spraying a shaving preparation directly onto an area of skin to form a dispersed layer of the shaving preparation without the need for hand spreading and shaving the area with a razor. Also disclosed is a dispensing apparatus for spraying a shaving preparation directly onto an area of skin to be shaved. The shaving preparation may be an aerosol or a non-aerosol shaving preparation.

U.S. Pat. No. 6,682,726 B2, issued Jan. 27, 2004. The invention is directed to a self-foaming shaving composition in the form of a lotion. The shaving composition comprises water, a water dispersible surface active agent capable of forming a lather, a volatile self-foaming agent, and a water soluble thickening agent wherein the composition is in the form of a self-foaming lotion having an elastic modulus (G') of about 100 to about 1000 Pascals, preferably about 200 to about 900 Pa, most preferably about 400 to about 800 Pa (measured with a rheometer at frequency 1 Hz, oscillatory stress range 0.01-1.0 Pa, temperature 5 DEG C., Gap 1000 microns). The present invention is also directed to an improved shaving method in which a shaving composition of the present invention is applied to an area of skin, and then said area is shaved, preferably with a wet razor.

U.S. Pat. No. 7,909,264 B2, issued Mar. 22, 2011. A discharge device and a method for evaporating a liquid to the atmosphere is proposed. The liquid pressurized by gas is supplied to an evaporator via a flow restriction device which restricts the flow rate of the liquid such that continuous release and evaporation of the liquid is possible. Further, an evaporator is proposed. The evaporator comprises an evaporation surface which is designed preferably by microstructuring such that the surface area is increased and/or the liquid forms an essentially uniform film on the evaporation surface.

U.S. Pat. No. 8,668,899 B2, issued Mar. 11, 2014. A sprayable polymeric foam hemostat for both compressible and non-compressible (intracavitary) acute wounds is disclosed. The foam comprises hydrophobically-modified polymers, such as hm-chitosan, or other amphiphilic polymers that anchor themselves within the membrane of cells in the vicinity of the wound. By rapidly expanding upon being released from a canister pressurized with liquefied gas propellant, the foam is able to enter injured body cavities and staunch bleeding. The seal created is strong enough to substantially prevent the loss of blood from these cavities. Hydrophobically-modified polymers supposedly prevent microbial infections and are suitable for oxygen transfer required during normal wound metabolism. The amphiphilic polymers form solid gel networks with blood cells to create a physical clotting mechanism that prevent loss of blood.

U.S. Pat. No. 8,876,020 B2, issued Nov. 4, 2014. A sprayable hydrogel wound dressing composed of an aqueous solution of neutralized Carbopol and silver hydrosol of silver nanoparticles electrolytically formed from silver metal without the use or inclusion of organic materials. The hydrogel is sprayed with a physical barrier sprayer system which separates the hydrogel from the propellant. The hydrogel is thixotropic/shear thinning so that the viscosity of the hydrogel is sufficient reduced in the sprayer to allow spray formation and regains sufficient viscosity to resist running when deposited on a vertical surface.

U.S. Patent Application Publication 2010/0218845 A1, published Sep. 2, 2010. One embodiment relates to a system including a first bag-on-valve aerosol container including a first valve comprising a first valve stem, and a body having an aperture extending therethrough from a first end of the body to a second end of the body. The aperture is sized to accept the first valve stem at the first end of the body. The aperture is also sized to accept a second valve stem at the second end of the body; the body sized to accept the first valve stem and a second valve stem at the same time.

U.S. Patent Application Publication 2012/0071581 A1, published Mar. 22, 2012. Additive combinations for various products allow the product to be dispensed from a BOV aerosol dispensing arrangement.

U.S. Patent Application Publication 2013/0345647 A1, published Dec. 26, 2013. Devices and methods for dispensing a fluidly dispensable material under pressure but without using a gas propellant are presented. In some embodiments an elastic sleeve is utilized to impart pressure to a bag of dispensable material positioned within the sleeve. Pressure so created pressurizes contents of the bag, which can then be dispensed through a valve. Methods for manufacturing various embodiments are presented.

U.S. Patent Application Publication 2014/0187469 A1, published Jul. 3, 2014. An aqueous formulation for dispensing as a spray polymeric microcapsules containing at least one active ingredient, the aqueous formulation comprising: (i) water; (ii) polymeric microcapsules having an oil-soluble core containing the at least one active ingredient; (iii) a cross linked acrylic acid co-polymer; (iv) a neutralizing amine for activating the cross linked acrylic acid copolymer to form a gel suspension for the polymeric microcapsules whereby the polymeric microcapsules are suspended in the water; (v) a chelant for protecting the aqueous formulation against destabilization by excessive metal ions; and (vi) an inhibitor for inhibiting bacterial growth in the water.

U.S. Patent Application Publication 2015/0056149 A1, published Feb. 26, 2015. A topical therapeutic hydrophobic breakable composition includes a carrier comprising (a) about 60% to about 99% by weight of at least one hydrophobic oil; (b) at least one viscosity-modifying agents selected from the group consisting of a fatty alcohol, a fatty acid and a wax; and (c) a tetracycline antibiotic, characterized in that at least part of the tetracycline antibiotic is suspended in the composition; the viscosity of the composition is at least about 30% higher than the viscosity of the carrier without the tetracycline antibiotic; and is higher than the viscosity of the hydrophobic oil and the tetracycline antibiotic without the viscosity modifying agents. The tetracycline is chemically stable in the composition for at least six months; wherein more than about 90% of the tetracycline has not broken down. The composition is packaged as a breakable foam that breaks easily upon application of shear force.

In view of the above, there is a need for a non-aspirating, non-propellant dispenser for dispensing a moisturizing thixotropic gel contained in a flexible bag in a pressurized gas container with the gel having a relatively high viscosity and the formed droplets being of a size that reduces drift potential.

SUMMARY OF THE INVENTION

It is an aspect of the present invention to provide a non-aspirating dispenser for ejecting a thixotropic gel.

It is another aspect of the present invention wherein the dispenser contains a flexible bag containing the gel with the bag located in a container having a non-flammable, non-hydrocarbon-based compressed gas therein.

A further object of the present invention is to provide non-foam gel droplets.

It is yet another aspect of the present invention that the dispenser does not require priming but continuously dispenses the gel in droplet form upon pushing an actuator to provide non-priming, aerosol-free droplets for use in the medical field as for keeping instruments moist, in order to prevent soils thereon from drying out. Soil that has been allowed to dry can make reprocessing of medical instruments more difficult and less effective.

Accordingly, one aspect of the invention relates to a non-aspirating dispenser for a transport gel, comprising: a thixotropic gel; said thixotropic gel having a viscosity of less than about 2,000 centipoises; said dispenser having walls forming a container and a flexible bag therein, said bag containing said thixotropic gel; a non-bag volume located between said dispenser walls and said flexible bag, said non-bag volume having a pressurized gas therein, said non-bag volume being substantially free of a propellant, a volatilizable liquid, or a foam forming gas, or any combination thereof; said dispenser having a valve, an actuator operatively connected to said valve, said actuator upon activation thereof being capable of opening said valve so that said pressurized gas will exert pressure on said bag and force said thixotropic gel out of said dispenser container in the form of non-aspirated droplets; and said droplets having a mean volume diameter that reduces drift potential.

BRIEF DESCRIPTION OF THE DRAWINGS

FIG. 1 relates to a cross-section elevation view of a non-aspirating dispenser of the present invention wherein a container contains a bag having a gel therein.

DETAILED DESCRIPTION OF THE INVENTION

Ergonomic friendly dispenser 10 of the present invention comprises an actuator 24. Actuator 24 is connected in any conventional manner such as through disconnectable valve 30 to dispenser container 40. The container contains a flexible bag 45 therein that through disconnectable valve 30 can be filled with a desired thixotropic gel of the present invention. Dispenser, container 40 can be in the shape of a cylinder or other suitable form and made of a pressure resistant material such as a metal, for example steel or aluminum or a plastic, such as Polyethylene terephthalate (PET). Bag 45 contains a thixotropic gel 50 therein. Non-bag or internal volume 47 located between bag 45 and dispenser container walls 40 contains a compressed eco-gas therein such as nitrogen, air, or $CO_2$. Suitable pressures range from about 25 to about 60 psi, and preferably from about 30 to about 50 psi.

It is an important aspect of the present invention that the compressed gas is not what would normally be considered a propellant, a volatilizable liquid, or a foam forming gas, or any combination thereof. By the term "propellant", it is meant that the gas in contact with the product is a volatile hydrocarbon such as various alkanes, for example propane, isopropane, butane, isobutene, or other volatile alkanes including various cyclic alkanes. Moreover, chloro-fluoro hydrocarbons as well as various fluoro-hydrocarbons are not utilized such as 1,1,1,2 tetrafluorethane (Dymel 134); 1,1, 1,2,3,3,3 heptafluoropropane (Dymel 227); 1,1, difluoro ethane (Dymel 152); or 1,1,1,2,2,2 hexafluoropropane. Such compounds are avoided because they are generally in contact with the product and volatilized to the air. Moreover, propellants can be flammable, toxic, and the like and hence the present invention is substantially free thereof. Other compounds that are avoided are volatilizable liquids that are liquids under pressure, but upon being emitted from container 40 at ambient pressure volatize. Examples of such gases include dimethyl ether, propane, isobutane, and n-butane. Gases that form a foam upon being emitted from dispenser 10 are also avoided by the present invention because they can obscure instruments visually, especially sharps. Also, upon breaking, the foams become liquid that readily runs off of the surface of the medical article. The foam can be formed either through trigger sprayers with a foaming tip or through the use of aerosols and propellants. Examples of gases that can form a foam include blend of propane and isobutane, A-31, P-152a, nitrous oxide, and $CO_2$.

The present invention is substantially free of the above noted propellants, volatilizable liquid; or foam forming gases. By the term "free thereof", it is meant that any such gases contained within non-bag or internal area 47, if used, exist in very minute amounts, for example about 5% or less, desirably about 3% or less, and preferably about 1% or less based upon the total volume of non-bag or internal volume 47. A highly preferred embodiment is that non-bag or internal volume 47 contains no such gases therein.

Another important aspect of the present invention is that dispenser 10 is a non-aspirating dispenser. That is, they do not utilize suction to take up various fluids, or air, and mix the same with gel 50 of the present invention. Aspirators are avoided because when utilized as in the medical field or industry, they can draw in air that is contaminated and then dispense the same in ejected material 26. Hence, viruses, bacteria, fungi, bodily fluids and other harmful materials can be contained in sprayer ejected material 26 that result in a harmful environment as in a sterile room, an operating room, etc. and the like. Moreover, such contaminated ejected material are generally in the form of small droplets that are driftable in the air and can thus readily enter adjacent rooms, areas, and the like and also contaminate the same. By the term "non-aspirating dispenser", it is meant that flexible bag 45 is under positive pressure due to the enclosed gas in the non-bag or internal volume 47 area that dispenses the gel outward under pressure with no flow back into the dispenser container due to pressure differential between the dispenser container as compared to the environment outside the dispenser container. In other words, said pressure differential is always at least 2 psi greater than the outside environment pressure during dispensing.

Dispenser 10 of the present invention containing non-aspirating nozzle 25 can be any conventional dispenser container known to the art and to the literature such as those manufactured by Ball, CCL Container, Crown, Exal, and actuators by such manufacturers Aptar, Coster, Lindal Group, and Precision Global.

Actuator portion 24 can be connected to dispenser container 40 in any conventional manner as known to the literature and to the art. In the embodiment of the present invention, dispenser container 40 is of a BOV, i.e. bag-on-valve, bottle, or container wherein, as shown in FIG. 1, flexible bag 45 is located within dispenser container 40. Bag 45 can be any conventional flexible material such as various plastic and metalized films typically laminated together for optimal barrier and compatibility properties. Examples of suitable flexible laminate materials include LLDPE/Nylon/Aluminum/Polyester, LLDPE/Polyester, PP/Nylon/Aluminum/Polyester, and LLPE/Aluminum/Nylon. The volume of bag 45 is generally from about 50 to about 90%, desirably from about 60% to about 80%, and preferably from about 65% to about 75% based upon the total volume of dispenser container 40. Thus, the non-bag or internal volume 47 (i.e. pressurized gas volume) is the remainder or difference, i.e. generally from about 10% to about 50%, desirably from about 20 to about 40%, and preferably from about 25 to about 35%.

Gel material 50 is a thixotropic gel inasmuch as it is generally a semi-solid at room temperature, but upon the application of pressure thereto, flows like a liquid. The purpose of the gel is to keep various medical instruments moist in order to prevent soils from drying out, which can make reprocessing of medical instruments more difficult and less effective. This invention may be used at a point of use for transport or prior to delayed reprocessing in a reprocessing area.

The type of gels utilized are those that contain one or more thickening agents to help with dispensing and cling properties, humectants to keep soils moist, corrosion inhibitors so that extended contact with moisture does not promote corrosion of instrumentation, surfactants to penetrate soils, sequestrants to aid in anti-redeposition, and preservatives to prevent contamination of the product and water. All of these compounds are well known to the art and to the literature. Gels that can be used include "Pre-Klenz", Instrument Transport Gel made by Steris Corporation, and OptiPro Instrument Gel made by Ecolab. Other examples of gel include cellulose, hydrophobically modified cellulose, guar gum, quaternized guar gum, alginate, or cationated alginate comprising calcium, magnesium, or sodium cations, or any combination thereof.

An important aspect of the present invention, in order to form proper size droplets of the gel once emitted from dispenser 10, is the viscosity thereof. Generally, the viscosity of the thixotropic gel is less than about 2,000, desirably from about 100 to about 1,700, and preferably from about 150 to about 1,500 centipoise.

The operation of dispenser 10 is generally as follows. A suitable amount of a particular type of gel, for example Pre-Klenz, is added to flexible bag 45. Through valve 30, an eco-gas such as air, etc., is added to dispenser container 40 with the eco-gas generally being located in non-bag or interior area 47. As noted, the amount of pressure therein can generally be from about 25 to about 60 psi, and desirably from about 30 to about 50, dependent upon the type of sprayer. Upon pressurizing interior area 47, valve 30 is closed to the bag. Dispenser 10 can be activated as by pressing actuator 24, or another release mechanism, that through a typical mechanical connection, opens valve 30 so that eco-gas 60 applies pressure to thixotropic gel 50 and forces the gel through the non-aspirating sprayer and is ejected through nozzle 25 in the form of ejected material 26 such as liquid droplets.

The size of the liquid droplets is another important aspect of the present invention. If they are too small, droplets will tend to drift, i.e. remain suspended in the air and could be diverted to an undesirable area such as the sterile field within a surgical suite or operating room. Thus, reduced drift potential is desired. If too heavy, the droplets conglomerate and will not spray on the instruments in fan spray pattern that gives adequate coverage but as more of a stream. Desirably, the mean volume droplet diameter ranges from about 80 to about 500, desirably from about 100 to about 450, and preferably from about 150 to about 400 microns, with about 250 microns being highly preferred. This droplet size can be tested with a piece of equipment such as the Malvern Spraytec Particle Size Analyzer, as per methods published by International Standards Organization ISO 13320 (2009) Particle Size Analysis-Laser Diffraction Methods. An ergonomic aspect of the present invention is that once actuator 24 is pressed, it remains open until released. Thus, a steady spray of droplets 26 of the thixotropic gel are emitted from nozzle 25 in a non-aspiratable form.

The non-aspirating dispenser of the present invention suitable for keeping instruments moist, in order to prevent soils thereon from drying out, that can make reprocessing of medical instruments more difficult and less effective. These soils could include blood, tissue, bodily fluids, mucus, feces, adipose tissue, synovial fluid, or other soils associated with medical procedures. In addition to surgical instruments such as forceps, hemostats, clamps, scalpels, retractors, bone saws, chisels, cannulas, curettes, osteotomes, rongeurs, other medical instruments such as endoscopes (both rigid and flexible), or probes can also be coated with the gel. The invention can be used at point of use for transport or prior to delayed reprocessing in the reprocessing area.

The following examples serve to explain the present invention, while not limiting the scope thereof.

The can sizes can be from 25 mm to 65 mm in diameter, the bag lengths from 50-240 mm in length, and from 79-120 mm in width prior to filling. Bags are placed into the cans in a rolled (flattened) state and as the bag fills with product bag rounds, decreasing the width.

The can preferably can be a 7 oz. aluminum 53×200 mm can, bag length 104 mm, bag width 97 mm or a 13.5 oz. aluminum 66×220 mm can, bag length 187 mm, bag width 124 mm with a 40 psi pressure and 70% fill volume. The bag material can be made of polyester/aluminum/nylon/polypropylene.

A prior art trigger sprayer will dispense about 1 gram per pull and about 1.1 grams per second average, not including priming. The priming can take up to an average of 16 pulls of the trigger. The present invention requires no priming and will dispense an average of 5.4 grams per second, and will continue dispensing until the pressure is exhausted from the actuator. In addition the droplet size is 250 microns (mean diameter based on volume distribution).

While in accordance with the Patent Statutes, the best mode and preferred embodiments have been set forth, the scope of the invention is not limited thereto, but rather, by the scope of the attached claims.

What is claimed is:

1. An ergonomic friendly non-aspirating dispenser for ejecting a thixotropic gel onto a medical article, comprising:

a dispenser, said dispenser having walls forming a container consisting of a single opening such that the container is closed to unrecited openings, a valve sealing the single opening of the container, a flexible bag positioned inside the container and having an initial bag volume inside the bag that is in communication with and operatively connected to the valve, a thixotropic gel located in the flexible bag and having a viscosity of from about 100 to about 1,500 centipoises, wherein said thixotropic gel includes a thickening agent, a humectant, a corrosion inhibitor, a surfactant, and a preservative, wherein the container has an internal volume, the entire internal volume consisting of a) the initial bag volume within the flexible bag that holds the thixotropic gel, b) a non-bag volume located between said dispenser walls, the valve, and said flexible bag, and c) the flexible bag, such that the entire internal volume is closed to unrecited elements, wherein the non-bag volume consists of a gas having an initial pressure of about 25 to about 50 psi such that the non-bag volume is closed to unrecited elements, wherein the gas is one or more of nitrogen, air and $CO_2$, wherein the initial bag volume is from about 65% to about 90% of the container internal volume, wherein said non-bag volume being free of a hydrocarbon propellant, a chloro-fluoro hydrocarbon, a fluorocarbon, a volatilizable liquid, or a foam forming gas, or any combination thereof, wherein an actuator is operatively connected to said valve, said actuator upon activation thereof does not produce an aerosol but is capable of opening said valve so that the gas exerting pressure on said flexible bag will force said thixotropic gel out of the flexible bag and said dispenser container in the form of non-aspirated droplets having a mean volume diameter from about 150 to about 500 microns, wherein the thixotropic gel is capable of covering said medical article, and wherein the dispenser is free of an aspirator.

2. The non-aspirating dispenser according to claim 1, wherein said thixotropic gel comprises cellulose, hydrophobically modified cellulose, guar gum, quarternized guar gum, alginate, or cationated alginate comprising calcium, magnesium, or sodium cations, or any combination thereof.

3. The non-aspirating dispenser according to claim 2, wherein said pressurized gas comprises air, carbon dioxide, or nitrogen, or any combination thereof.

4. The non-aspirating dispenser according to claim 3, wherein said viscosity of said thixotropic gel is from about 150 to less than 1,500 centipoises, and wherein said mean volume diameter of said droplets is from about 100 to about 400 microns.

5. The non-aspirating dispenser according to claim 4, wherein said mean volume diameter of said droplets is about 250 microns; wherein the volume of said bag is from about 65% to about 75% based upon the total volume of said dispenser container, and wherein said non-bag volume pressure is from about 30 to about 50 psi.

6. An ergonomic friendly non-aspirating dispenser for ejecting a thixotropic gel, comprising:

a dispenser, said dispenser having walls forming a container consisting of a single opening such that the container is closed to unrecited openings, a valve sealing the single opening of the container, a flexible bag positioned inside the container and having an initial bag volume inside the bag that is in communication with and operatively connected to the valve, a thixotropic gel located in the flexible bag and having a viscosity of from about 100 to about 1,500 centipoises, wherein the container has an internal volume, the entire internal volume consisting of a) the initial bag volume within the flexible bag that holds the thixotropic gel, b) a non-bag volume located between said dispenser walls, the valve, and outer surface of said flexible bag, and c) the flexible bag, such that the entire internal volume is closed to unrecited elements, wherein the non-bag volume consists of a gas having an initial pressure of about 25 to about 50 psi such that the non-bag volume is closed to unrecited elements, wherein the gas is one or more of nitrogen, air and $CO_2$, wherein the initial bag volume is from about 65% to about 90% of the container internal volume, wherein said non-bag volume being free of a hydrocarbon propellant, a chloro-fluoro hydrocarbon, a fluorocarbon, a volatilizable liquid, or a foam forming gas, or any combination thereof, wherein an actuator is operatively connected to said valve, said actuator upon activation thereof being capable of opening said valve so that the gas exerting pressure on said flexible bag will force said thixotropic gel out of the flexible bag and said dispenser container in the form of non-aspirated droplets having a mean volume diameter from about 150 to about 500 microns, and wherein the dispenser is free of an aspirator.

7. The non-aspirating dispenser according to claim 6, wherein said viscosity of said thixotropic gel is from about 150 to less than 1,500 centipoises, and wherein said mean volume diameter of said droplets is from about 100 to about 450 microns.

8. The non-aspirating dispenser according to claim 7, wherein said mean volume diameter of said droplets is about 150 to about 400 microns; and said flexible bag is from about 60% to about 80% based upon the total volume of said dispenser container.

9. The non-aspirating dispenser according to claim 8, wherein said thixotropic gel comprises cellulose, hydrophobically modified cellulose, guar gum, quaternized guar gum, alginate, or cationated alginate comprising calcium, magnesium, or sodium cations, or any combination thereof.

10. The non-aspirating dispenser according to claim 9, wherein said pressurized gas comprises air, carbon dioxide, or nitrogen, or any combination thereof.

11. The non-aspirating dispenser according to claim 9, that is capable of applying said thixotropic gel to a medical article.

* * * * *